US010434619B1

(12) United States Patent
Santelli

(10) Patent No.: US 10,434,619 B1
(45) Date of Patent: Oct. 8, 2019

(54) SANDING TOOL

(71) Applicant: Giuseppe Santelli, Itasca, IL (US)

(72) Inventor: Giuseppe Santelli, Itasca, IL (US)

( * ) Notice: Subject to any disclaimer, the term of this patent is extended or adjusted under 35 U.S.C. 154(b) by 79 days.

(21) Appl. No.: 15/805,323

(22) Filed: Nov. 7, 2017

(51) Int. Cl.
*B24B 23/00* (2006.01)
*B24B 23/04* (2006.01)

(52) U.S. Cl.
CPC ..... *B24B 23/046* (2013.01)

(58) Field of Classification Search
CPC ..... B24B 23/00
USPC ..... 451/354, 523, 524, 525, 557
See application file for complete search history.

(56) References Cited

U.S. PATENT DOCUMENTS 2,201,645 A * 5/1940 Epner ..... B24D 15/023 15/231
2,523,697 A 9/1950 Harrington
3,822,518 A * 7/1974 Sjostrand ..... B24D 15/023 451/516
3,973,362 A * 8/1976 Groshans ..... B24D 15/023 451/516
D311,318 S 10/1990 Ovens
5,902,176 A 5/1999 Chen
6,626,746 B2 * 9/2003 Mayr ..... B24B 23/005 451/344
6,935,936 B2 8/2005 Goulet
7,144,300 B1 12/2006 Cybulski
7,416,477 B2 8/2008 Henke
7,488,242 B2 * 2/2009 Gringer ..... B24D 15/04 451/344
2005/0054278 A1 * 3/2005 Huang ..... B24D 15/023 451/344

FOREIGN PATENT DOCUMENTS

WO 2006118864 A1 11/2006

* cited by examiner

*Primary Examiner* — Robert A Rose
(74) *Attorney, Agent, or Firm* — Kyle A. Fletcher, Esq.

(57) ABSTRACT

The sanding tool comprises a base, a handle, a first clip, and a second clip. A sheet of sandpaper is held in place against the bottom of the block by the clips. A user grasps the sanding tool by the handle and moves the sandpaper against an object to sand the object. The clips each comprise a wire armature that traps an end of the sandpaper between a plate and a handle block. The wire armature passes through and hinges at the handle block. The ends of the wire armature are coupled to the plate. The wire armature extends towards the center of the block on one side and forms a loop. The position of the loop may be changed to release or retain the sandpaper within the clip. The loop may be retained by a knurled screw into a platform on the block.

16 Claims, 4 Drawing Sheets

SANDING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tool, more specifically, a sanding tool.

SUMMARY OF INVENTION

The sanding tool comprises a base, a handle, a first clip, and a second clip. A sheet of sandpaper is held in place against the bottom of the block by the clips. A user grasps the sanding tool by the handle and moves the sandpaper against an object to sand the object. The clips each comprise a wire armature that traps an end of the sandpaper between a plate and a handle block. The wire armature passes through and hinges at the handle block. The ends of the wire armature are coupled to the plate. The wire armature extends towards the center of the block on one side and forms a loop. The position of the loop may be changed to release or retain the sandpaper within the clip. The loop may be retained by a knurled screw into a platform on the block.

An object of the invention is to retain a sheet of sandpaper against a bottom surface of a tool used to sand an object.

Another object of the invention is to retain the sandpaper at each end using a clip.

A further object of the invention is to form the clip from a plate and a wire armature such that the wire armature hinges to trap or release the sandpaper between the plate and a handle block.

Yet another object of the invention is to prevent movement of the wire armature using a knurled screw.

These together with additional objects, features and advantages of the sanding tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the sanding tool in detail, it is to be understood that the sanding tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sanding tool.

It is therefore important that the claims be regarded as including such equivalent construction insofar as they do not depart from the spirit and scope of the sanding tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
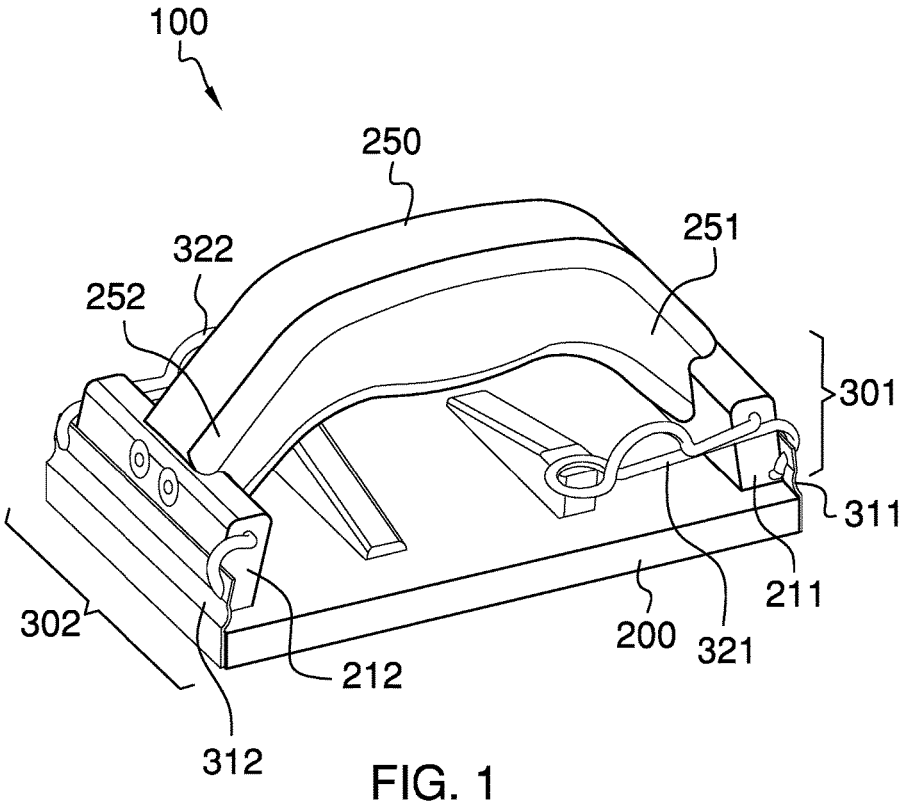
FIG. 1 is a perspective view of an embodiment of the disclosure.
Figure 2:
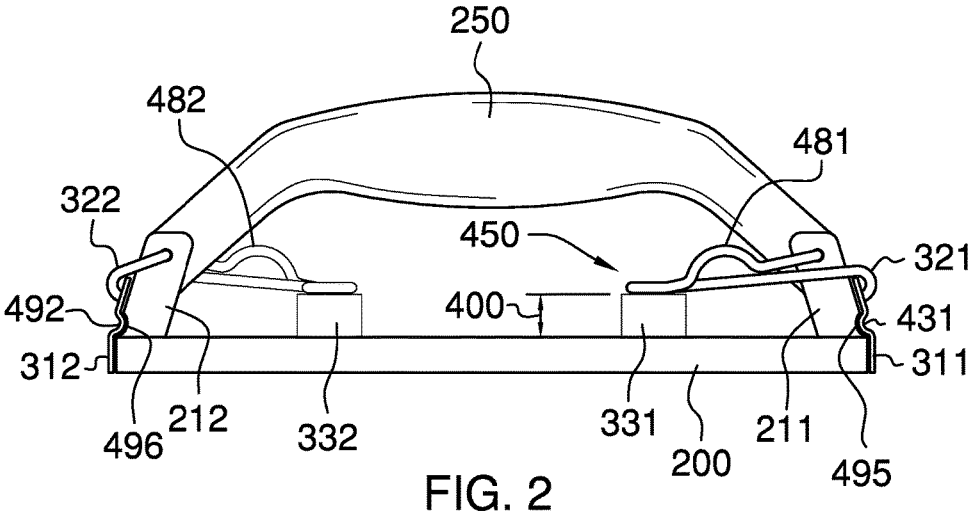
FIG. 2 is a side view of an embodiment of the disclosure.
Figure 3:
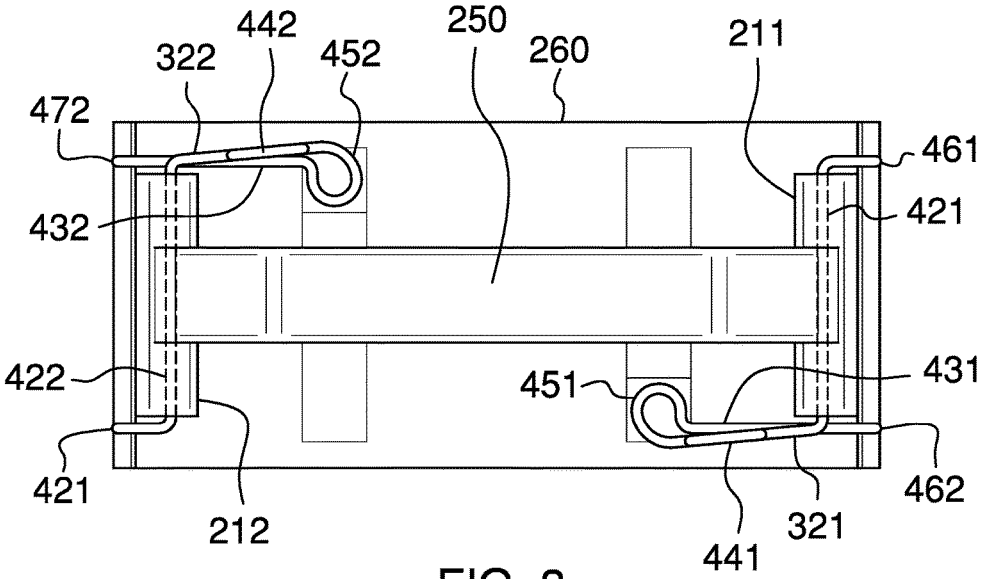
FIG. 3 is a top view of an embodiment of the disclosure.
Figure 4:
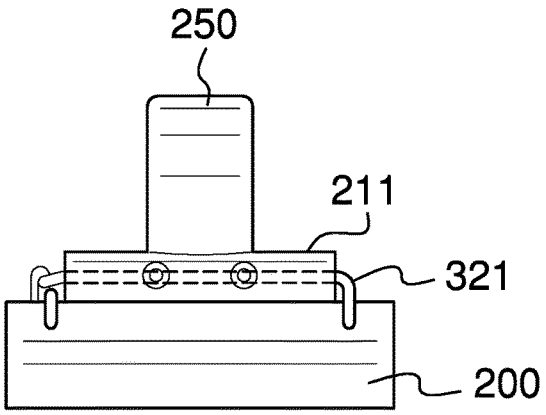
FIG. 4 is a front view of an embodiment of the disclosure.
Figure 5:
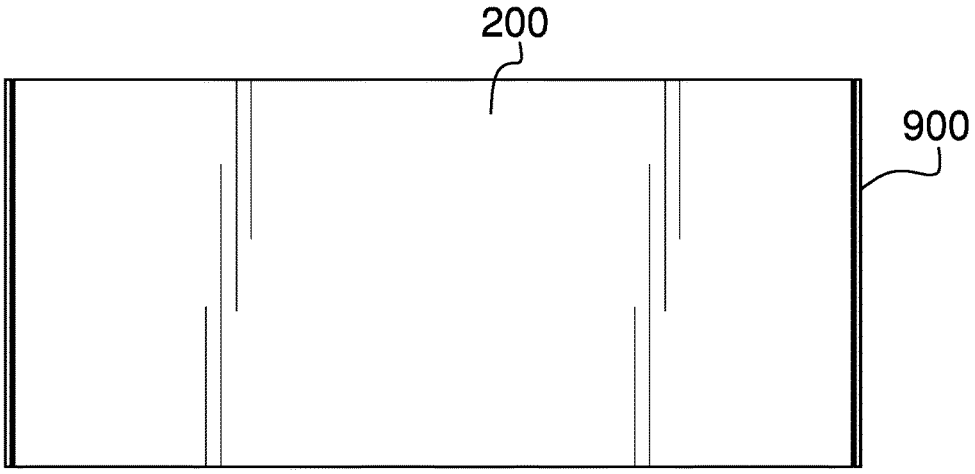
FIG. 5 is a bottom view of an embodiment of the disclosure.
Figure 6:
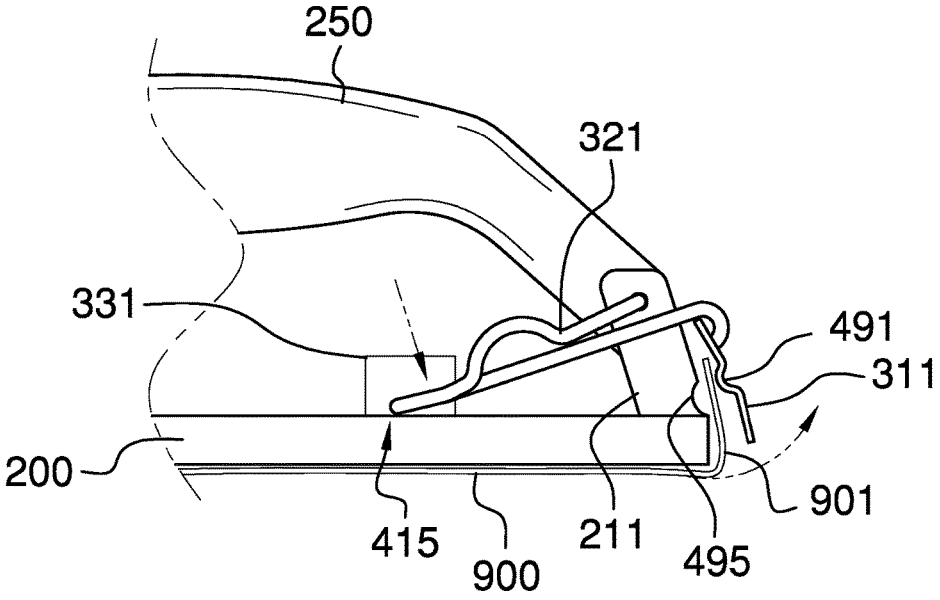
FIG. 6 is a detail view of an embodiment of the disclosure.

Detailed reference will now be made to a first potential embodiment of the disclosure, which is illustrated in FIGS. 1 through 6.

The sanding tool 100 (hereinafter invention) comprises a base 200, a handle 250, a first clip 301, and a second clip 302. The invention 100 holds a sheet of sandpaper 900 against the bottom surface of the base 200. The sheet of sandpaper 900 is retained by the first clip 301 and the second clip 302. A user (not illustrated in the figures) of the invention 100 may sand an object (not illustrated in the figures) by grasping the handle 250 of the invention 100 and rubbing the sheet of sandpaper 900 over the object.

The base 200 may be a rectangular block of a rigid material. The top surface of the base 200 may comprise a first handle block 211 and a second handle block 212. The first handle block 211 and the second handle block 212 may be mounting points for the handle 250. The first handle block 211 and the second handle block 212 may be coupled to the base 200 or may be upward extensions of the base 200. The first handle block 211 and the second handle block 212 may be oriented in a lateral direction, centered laterally, and extending across 50% to 100% of the lateral distance of the base 200. The first handle block 211 and the second handle block 212 may be located on opposing longitudinal sides of the base 200. The first handle block 211 and the second handle block 212 may each be flush with the closest longitudinal end of the base 200.

In some embodiments, the first handle block 211 and the second handle block 212 may be inclined towards the center of the base 200 as they rise above the base 200.

The base 200 may further comprise a first knob platform 331 and a second knob platform 332. The first knob platform 331 and the second knob platform 332 may be elevated areas of the top surface of the base 200, which are resting areas for a first wire armature 321 and a second wire armature 322, respectively. The first knob platform 331 and the second knob platform 332 may be located on opposing lateral sides of the base 200 and on opposing longitudinal sides of the base 200. The height of the first knob platform 331 and the second knob platform 332 above the top surface of the base 200 may be a closed clip lever height 400.

The bottom surface of the base 200 is flat and the sheet of sandpaper 900 is stretched over the flat, bottom surface of the base 200 in a lengthwise direction with the ends of the sheet of sandpaper 900 turning upwards to cover the ends of the base 200. The sheet of sandpaper 900 is held in place by the first clip 301 and the second clip 302. Specifically, a first end of the sandpaper 901 is held in place by the first clip 301 and a second end of the sandpaper (not illustrated in the figures) is held in place by the second clip 302.

The handle 250 may be an arched grip for grasping the invention 100. A first end of the handle 251 may be coupled to the first handle block 211 and a second end of the handle 252 may be coupled to the second handle block 212. The arch of the handle 250 is oriented to increase the distance between the handle 250 and the base 200 at the center of the handle 250 in comparison to the distance between the handle 250 and the base at either the first end of the handle 251 or the second end of the handle 252.

The first clip 301 comprises a first end plate 311 and the first wire armature 321. The first end plate 311 presses against the first handle block 211 to trap the first end of the sandpaper 901 between the first end plate 311 and the first handle block 211. The first end plate 311 is pressed against the first handle block 211 by the first wire armature 321 when the first wire armature 321 is in a closed position 410. The first end plate 311 moves away from the first handle block 211 allowing the sheet of sandpaper 900 to be removed from the first clip 301 when the first wire armature 321 is in an open position 415.

The first wire armature 321 may comprise a first transverse arm 421, a first longitudinal arm 431, a first lift arm 441, a first loop 451, a first end of the first lever 461, and a first end of the second lever 471. The first wire armature 321 may be a rigid, L-shaped wire that presses the first end plate 311 against the first handle block 211.

The first transverse arm 421 may be oriented horizontally and may pass through a hole or slot in the first handle block 211. As it emerges from the first handle block 211, the first transverse arm 421 may bend towards the closest longitudinal edge and pass horizontally over the top of the first end plate 311. The first end of the first lever 461 may then curl down and back and the first end of the first lever 461 may couple with the first end plate 311.

As it emerges from the opposite side of the first handle block 211, the first transverse arm 421 may bend away from the closest longitudinal edge and pass horizontally towards the opposite end of the base 200. This section of the first wire armature 321 that extends from the first handle block 211 towards the opposite end of the base 200 is called the first lift arm 441.

The first lift arm 441 may follow an arched path from the first handle block 211 to the first knob platform 331. A first arch 481 formed by the first lift arm 441 is oriented to rise vertically and then fall back to the original path of the first lift arm 441. The first arch 481 provides access for a user's finger (not illustrated in the figures) to pull upwards on the first wire armature 321.

When the first lift arm 441 reaches the first knob platform 331, it may turn horizontally towards the longitudinal center-line of the base 200 through an angle of 270 degrees to form the first loop 451. The first wire armature 321 may then turn horizontally towards the closet longitudinal edge through an angle of 90 degrees and may extend forward to form the first longitudinal arm 431.

The first longitudinal arm 431 may extend forward and pass horizontally over the top of the first end plate 311. The first end of the second lever 471 may then curl down and back and the first end of the second lever 471 may couple with the first end plate 311.

The first clip 301 thus formed hinges around the first transverse arm 421 as it passes through the first handle block 211. When the first loop 451 is resting on the first knob platform 331, the first wire armature 321 presses the first end plate 311 against the first handle block 211 and traps the first end of the sandpaper 901. When the first loop 451 is pulled towards the closest lateral edge and allowed to drop from the first knob platform 331 onto the base 200, the first end plate 311 lifts away from the first handle block 211 and releases the first end of the sandpaper 901. Once the sheet of sandpaper 900 has been replaced, the first loop 451 may be lifted using the first arch 481 and then slid onto the first knob platform 331. The first end plate 311 will be moved to a position against the first handle block 211 to trap the sheet of sandpaper 900.

The first end plate 311 may comprise a first ridge 491 and the first handle block 211 may comprise a first indentation 495. The first ridge 491 may extended transversely across the width of the first end plate 311. The first indentation 495 may extend transversely across the width of the first handle block 211. The first ridge 491 and the first indentation 495 may be positioned and oriented such that when the first clip 301 is in the closed position 410, the first ridge 491 may nest within the first indentation 495. This increases the friction between the first clip 301 and the first end of the sandpaper 901 and holds the sheet of sandpaper 900 in place more effectively.

The second clip 302 comprises a second end plate 312 and the second wire armature 322. The second end plate 312 presses against the second handle block 212 to trap the second end of the sandpaper between the second end plate 312 and the second handle block 212. The second end plate 312 is pressed against the second handle block 212 by the second wire armature 322 when the second wire armature 322 is in the closed position 410. The second end plate 312 moves away from the second handle block 212 allowing the sheet of sandpaper 900 to be removed from the second clip 302 when the second wire armature 322 is in the open position 415.

The second wire armature 322 may comprise a second transverse arm 422, a second longitudinal arm 432, a second lift arm 442, a second loop 452, a second end of the first lever 462, and a second end of the second lever 472. The second wire armature 322 may be a rigid, L-shaped wire that presses the second end plate 312 against the second handle block 212.

The second transverse arm 422 may be oriented horizontally and may pass through a hole or slot in the second handle block 212. As it emerges from the second handle block 212, the second transverse arm 422 may bend towards the closest longitudinal edge and pass horizontally over the top of the second end plate 312. The second end of the first lever 462 may then curl down and back and the second end of the first lever 462 may couple with the second end plate 312.

As it emerges from the opposite side of the second handle block 212, the second transverse arm 422 may bend away from the closest longitudinal edge and pass horizontally towards the opposite end of the base 200. This section of the second wire armature 322 that extends from the second handle block 212 towards the opposite end of the base 200 is called the second lift arm 442.

The second lift arm 442 may follow an arched path from the second handle block 212 to the second knob platform 332. A second arch 482 formed by the second lift arm 442 is oriented to rise vertically and then fall back to the original path of the second lift arm 442. The second arch 482 provides access for the user's finger to pull upwards on the second wire armature 322.

When the second lift arm 442 reaches the second knob platform 332, it may turn horizontally towards the longitudinal center-line of the base 200 through an angle of 270 degrees to form the second loop 452. The second wire armature 322 may then turn horizontally towards the closet longitudinal edge through an angle of 90 degrees and may extend forward to form the second longitudinal arm 432.

The second longitudinal arm 432 may extend forward and pass horizontally over the top of the second end plate 312. The second end of the second lever 472 may then curl down and back and the second end of the second lever 472 may couple with the second end plate 312.

The second clip 302 thus formed hinges around the second transverse arm 422 as it passes through the second handle block 212. When the second loop 452 is resting on the second knob platform 332, the second wire armature 322 presses the second end plate 312 against the second handle block 212 and traps the second end of the sandpaper. When the second loop 452 is pulled towards the closest lateral edge and allowed to drop from the second knob platform 332 onto the base 200, the second end plate 312 lifts away from the second handle block 212 and releases the second end of the sandpaper. Once the sheet of sandpaper 900 has been replaced, the second loop 452 may be lifted using the second arch 482 and then slid onto the second knob platform 332. The second end plate 312 will be moved to a position against the second handle block 212 to trap the sheet of sandpaper 900.

The second end plate 312 may comprise a second ridge 492 and the second handle block 212 may comprise a second indention 496. The second ridge 492 may extended transversely across the width of the second end plate 312. The second indention 496 may extend transversely across the width of the second handle block 212. The second ridge 492 and the second indention 496 may be positioned and oriented such that when the second clip 302 is in the closed position 410, the second ridge 492 may nest within the second indention 496. This increases the friction between the second clip 302 and the second end of the sandpaper and holds the sheet of sandpaper 900 in place more effectively.

In use, the first clip 301 and the second clip 302 are opened via moving the first wire armature 321 and the second wire armature 322 to the open position 415. The sheet of sandpaper 900 is attached by place the first end of the sandpaper 901 between the first handle block 211 and the first end plate 311 and by placing the second end of the sandpaper between the second handle block 212 and the second end plate 312. The first clip 301 and the second clip 302 are then closed upon moving the first wire armature 321 and the second wire armature 322 to the closed position 410. The user may then hold the invention 100 by the handle 250 and press the sheet of sandpaper 900 against the object. Moving the invention 100 over the object may sand material off of the object.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "clip" is a fastener that attaches to an object by gripping or clasping the object. A clip is typically spring loaded.

As used herein, the words "couple", "couples", "coupled" or "coupling", mean connected, either directly or indirectly and does not necessarily imply a mechanical connection.

As used in this disclosure, the term "flush" is used to describe the alignment of a first surface and a second surface on a single plane.

As used herein, "front" means the side of an object that is closest to a forward direction of travel under normal use of the object or the side or part of an object that normally presents itself to view or that is normally used first. "Rear" or "back" refers to the side that is opposite the front.

As used in this disclosure, a "handle" is an object by which a tool, object, or door is held or manipulated with the hand.

As used in this disclosure, the word "lateral" or "laterally" refers to the sides of an object or movement towards a side. Lateral directions are generally perpendicular to longitudinal directions.

As used herein, a "lateral edge" or "lateral end" is an edge or end that is reached when traversing an object in a lateral direction.

As used herein, the word "longitudinal" or "longitudinally" refers to a lengthwise or longest direction.

As used herein, a "longitudinal edge" or "longitudinal end" is an edge or end that is reached when traversing an object in a longitudinal direction.

As used herein, "opposing lateral sides" refers to two locations that are on opposite sides of a longitudinal center line that divides an object.

As used herein, "opposing longitudinal sides" refers to two locations that are on opposite sides of a lateral center line that divides an object.

As used in this disclosure, a "ridge" is an elevated or raised portion of a structure.

As used in this disclosure, "rigid" refers to a structure that has three-dimensional stability but that resists a decrease in internal volume when subjected to an external force. A rigid structure will behave in an elastic manner in the sense that when the external force is removed the internal volume will return to its original volume. This definition is consistent with the definition of rigid as described in the Cooperative Patent Classification system as described in section A45C.

Luggage Reference

As used in this disclosure, a "tool" is a device, an apparatus, or an instrument that is used to carry out an activity, operation, or procedure.

As used in this disclosure, a "wire" is a structure with the general appearance of a cord or strand but that: 1) may not have the tensile or compressive characteristics of a cord; and, 2) is made from an electrically conductive material.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sanding tool comprising:

a base, a handle, a first clip, and a second clip;

wherein the sanding tool holds a sheet of sandpaper against the bottom surface of the base;

wherein the sheet of sandpaper is retained by the first clip and the second clip;

wherein the sanding tool is adapted for a user of the sanding tool to sand an object by grasping the handle of the sanding tool and rubbing the sheet of sandpaper over the object;

wherein the base is a rectangular block of a rigid material;

wherein the top surface of the base comprises a first handle block and a second handle block;

wherein the first handle block and the second handle block is mounting points for the handle;

wherein the first handle block and the second handle block is coupled to the base or is upward extensions of the base;

wherein the first handle block and the second handle block are oriented in a lateral direction, centered laterally, and extending across 50% to 100% of the lateral distance of the base;

wherein the first handle block and the second handle block are located on opposing longitudinal sides of the base;

wherein the first handle block and the second handle block are each flush with the closest longitudinal end of the base;

wherein the base further comprise a first knob platform and a second knob platform;

wherein the first knob platform and the second knob platform are elevated areas of the top surface of the base which are resting areas for a first wire armature and a second wire armature, respectively;

wherein the first knob platform and the second knob platform are located on opposing lateral sides of the base and on opposing longitudinal sides of the base;

wherein the height of the first knob platform and the second knob platform above the top surface of the base is a closed clip lever height.

2. The sanding tool according to claim 1 wherein the bottom surface of the base is flat and the sheet of sandpaper is stretched over the flat, bottom surface of the base in a lengthwise direction with the ends of the sheet of sandpaper turning upwards to cover the ends of the base;

wherein the sheet of sandpaper is held in place by the first clip and the second clip;

wherein specifically, a first end of the sandpaper is held in place by the first clip and a second end of the sandpaper is held in place by the second clip.

3. The sanding tool according to claim 2 wherein the handle is an arched grip for grasping the sanding tool;

wherein a first end of the handle is coupled to the first handle block and a second end of the handle is coupled to the second handle block;

wherein the arch of the handle is oriented to increase the distance between the handle and the base at the center of the handle in comparison to the distance between the handle and the base at either the first end of the handle or the second end of the handle.

4. The sanding tool according to claim 3 wherein the first clip comprises a first end plate and the first wire armature;

wherein the first end plate presses against the first handle block to trap the first end of the sandpaper between the first end plate and the first handle block;

wherein the first end plate is pressed against the first handle block by the first wire armature when the first wire armature is in a closed position;

wherein the first end plate moves away from the first handle block allowing the sheet of sandpaper to be removed from the first clip when the first wire armature is in an open position.

5. The sanding tool according to claim 4 wherein the second clip comprises a second end plate and the second wire armature;

wherein the second end plate presses against the second handle block to trap the second end of the sandpaper between the second end plate and the second handle block;

wherein the second end plate is pressed against the second handle block by the second wire armature when the second wire armature is in the closed position;

wherein the second end plate moves away from the second handle block allowing the sheet of sandpaper to be removed from the second clip when the second wire armature is in the open position.

6. The sanding tool according to claim 5 wherein the first wire armature comprises a first transverse arm, a first longitudinal arm, a first lift arm, a first loop, a first end of the first lever, and a first end of the second lever;

wherein the first wire armature is a rigid, L-shaped wire that presses the first end plate against the first handle block;

wherein the second wire armature comprises a second transverse arm, a second longitudinal arm, a second lift arm, a second loop, a second end of the first lever, and a second end of the second lever;

wherein the second wire armature is a rigid, L-shaped wire that presses the second end plate against the second handle block.

7. The sanding tool according to claim 6 wherein the first transverse arm is oriented horizontally and passes through a hole or slot in the first handle block;

wherein as it emerges from the first handle block, the first transverse arm bends towards the closest longitudinal edge and passes horizontally over the top of the first end plate;

wherein the first end of the first lever curls down and back;

wherein the first end of the first lever couples with the first end plate.

8. The sanding tool according to claim 7 wherein the second transverse arm is oriented horizontally and passes through a hole or slot in the second handle block;

wherein as it emerges from the second handle block, the second transverse arm bends towards the closest longitudinal edge and pass horizontally over the top of the second end plate;

wherein the second end of the first lever curls down and back;

wherein the second end of the first lever couples with the second end plate.

9. The sanding tool according to claim 8 wherein as it emerges from the opposite side of the first handle block, the first transverse arm bends away from the closest longitudinal edge and pass horizontally towards the opposite end of the base;

wherein a section of the first wire armature that extends from the first handle block towards the opposite end of the base is called the first lift arm;

wherein as it emerges from the opposite side of the second handle block, the second transverse arm bends away from the closest longitudinal edge and pass horizontally towards the opposite end of the base;

wherein a section of the second wire armature that extends from the second handle block towards the opposite end of the base is called the second lift arm.

10. The sanding tool according to claim 9 wherein the first lift arm follows an arched path from the first handle block to the first knob platform;

wherein a first arch formed by the first lift arm is oriented to rise vertically and then fall back to the original path of the first lift arm;

wherein the first arch is adapted to provide access for a user's finger to pull upwards on the first wire armature;

wherein the second lift arm follows an arched path from the second handle block to the second knob platform;

wherein a second arch formed by the second lift arm is oriented to rise vertically and then fall back to the original path of the second lift arm;

wherein the second arch is adapted to provide access for the user's finger to pull upwards on the second wire armature.

11. The sanding tool according to claim 10 wherein when the first lift arm reaches the first knob platform, it turns horizontally towards the longitudinal center line of the base through an angle of 270 degrees to form the first loop;

wherein the first wire armature turns horizontally towards the closet longitudinal edge through an angle of 90 degrees;

wherein the first wire armature extends forward to form the first longitudinal arm;

wherein when the second lift arm reaches the second knob platform, it turns horizontally towards the longitudinal center line of the base through an angle of 270 degrees to form the second loop;

wherein the second wire armature turns horizontally towards the closet longitudinal edge through an angle of 90 degrees;

wherein the second wire armature extends forward to form the second longitudinal arm.

12. The sanding tool according to claim 11 wherein the first longitudinal arm extends forward and passes horizontally over the top of the first end plate;

wherein the first end of the second lever curls down and back and the first end of the second lever couples with the first end plate;

wherein the second longitudinal arm extends forward and passes horizontally over the top of the second end plate;

wherein the second end of the second lever curls down and back and the second end of the second lever couples with the second end plate.

13. The sanding tool according to claim 12 wherein the first clip hinges around the first transverse arm as it passes through the first handle block;

wherein when the first loop is resting on the first knob platform, the first wire armature presses the first end plate against the first handle block and traps the first end of the sandpaper;

wherein when the first loop is pulled towards the closest lateral edge and allowed to drop from the first knob platform onto the base, the first end plate lifts away from the first handle block and releases the first end of the sandpaper;

wherein once the sheet of sandpaper has been replaced, the first loop is lifted using the first arch and then slid onto the first knob platform;

wherein the first end plate is moved to a position against the first handle block to trap the sheet of sandpaper.

14. The sanding tool according to claim 13 wherein the second clip hinges around the second transverse arm as it passes through the second handle block;

wherein when the second loop is resting on the second knob platform, the second wire armature presses the second end plate against the second handle block and traps the second end of the sandpaper;

wherein when the second loop is pulled towards the closest lateral edge and allowed to drop from the second knob platform onto the base, the second end plate lifts away from the second handle block and releases the second end of the sandpaper;

wherein once the sheet of sandpaper has been replaced, the second loop is lifted using the second arch and then slid onto the second knob platform;

wherein the second end plate is moved to a position against the second handle block to trap the sheet of sandpaper.

15. The sanding tool according to claim 14 wherein the first end plate comprises a first ridge;

wherein the first handle block comprises a first indentation;

wherein the first ridge extends transversely across the width of the first end plate;

wherein the first indentation extends transversely across the width of the first handle block;

wherein the first ridge and the first indentation are positioned and oriented such that when the first clip is in the closed position, the first ridge nests within the first indentation.

16. The sanding tool according to claim 15 wherein the second end plate comprises a second ridge;

wherein the second handle block comprises a second indention;

wherein the second ridge extends transversely across the width of the second end plate;

wherein the second indention extends transversely across the width of the second handle block;

wherein the second ridge and the second indention are positioned and oriented such that when the second clip is in the closed position, the second ridge nests within the second indention.

* * * * *